United States Patent [19]

Cohen et al.

[11] 4,163,176

[45] Jul. 31, 1979

[54] ENERGY SAVING FLUORESCENT LAMP

[75] Inventors: Sheppard Cohen, Danvers; Fredrick W. Paget, Rockport; William J. Roche, Merrimac; Tadius T. Sadoski, Salem; Carlo S. Bessone, Cambridge, all of Mass.

[73] Assignee: GTE Sylvania Incorporated, Stamford, Conn.

[21] Appl. No.: 840,408

[22] Filed: Oct. 7, 1977

[51] Int. Cl.[2] ..... H01J 17/34; H01J 61/56

[52] U.S. Cl. ..... 315/53; 315/58; 315/62; 315/70

[58] Field of Search ..... 315/53, 57, 58, 62, 315/70, 71

[56] References Cited

U.S. PATENT DOCUMENTS

| | | | |
|---|---|---|---|
| 3,954,316 | 5/1976 | Luchetta | 315/96 |
| 4,082,981 | 4/1978 | Morton et al. | 315/53 X |

*Primary Examiner*—Alfred E. Smith
*Assistant Examiner*—Charles F. Roberts
*Attorney, Agent, or Firm*—James Theodosopoulos

[57] ABSTRACT

A fluorescent lamp has an extension base at one end thereof which contains an impedance to reduce current flow through the lamp. The length of the lamp plus extension base equals the length of a standard fluorescent lamp.

6 Claims, 2 Drawing Figures

ENERGY SAVING FLUORESCENT LAMP

THE INVENTION

This invention is concerned with energy-saving fluorescent lamps. In some cases energy can be saved in fluorescent lamp installations, at some sacrifice in total light output, by removing some of the overhead lamps or by removing one lamp of a series pair and replacing the lamp with a dummy lamp containing a capacitor. This invention is an improvement over such an expedient in that it affects the light distribution pattern less than does lamp removal or the use of a dummy lamp device and also provides more flexibility. Another method of reducing power consumption, again at some sacrifice in light output, involves detaching some of the wires between a fluorescent lamp ballast and the lamp, and then connecting in the circuit a transformer-capacitor combination, as disclosed in U.S. Pat. No. 3,954,316. Our invention is simpler since it does not involve rewiring, and is also more flexible.

This invention discloses a fluorescent lamp that is shorter than a standard lamp, that is to say, it is shorter than the space between the sockets in which the lamp is mounted. At one end of the lamp there is attached an extension base such that the length of the lamp plus extension base equals that of a standard lamp; that is to say, the length of the lamp plus extension base equals said space between sockets. The extension base contains an impedance such as a capacitor or inductance which is in series with the lamp and which is selected to reduce the current flow through the lamp and, therefore, the power consumption of the lamp. Thus, in order to reduce power consumption in an existing installation having, for example, a dual lamp ballast operating two lamps in series, it is only necessary to remove one of the lamps and replace it with a lamp plus extension base as per this invention.

Figure 1:
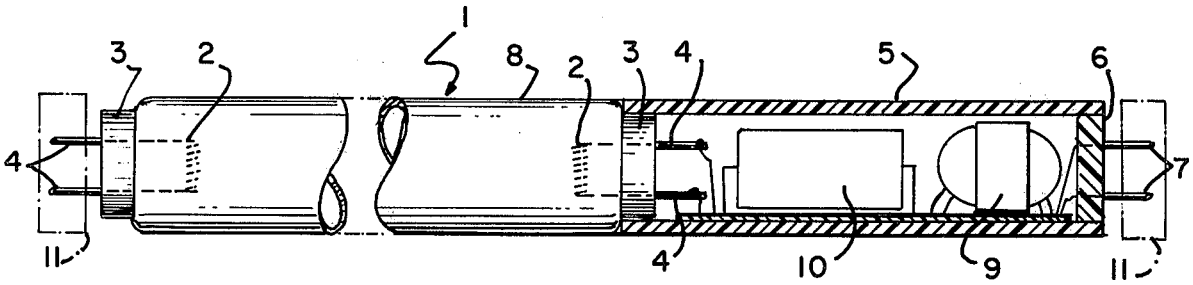

FIG. 1 in the drawing is a broken plan view, partly in section, of one embodiment of a fluorescent lamp and extension base in accordance with this invention.

Figure 2:
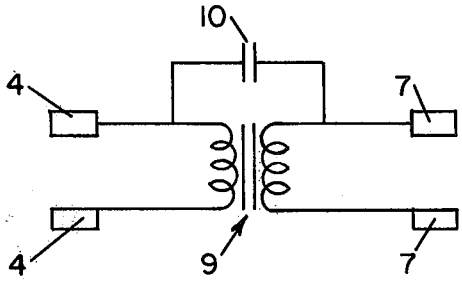

FIG. 2 is a schematic diagram of said embodiment.

Lamp 1 in the drawing is a fluorescent lamp containing the usual phosphor coating on the inner wall of glass envelope 8 and having the usual electrodes 2, bases 3 and pins 4 at each end. Lamp 1 is shorter than a standard 40 watt T12 lamp, say, 45 inches versus the standard length of 48 inches. In the standard lamp, the starting gas pressure is 2.5 torr. In our shorter lamp 1 the starting gas pressure is increased to 4 torr in order to maintain the same striking voltage as a standard lamp.

Attached to one end of lamp 1 is extension base 5 which, in this example, extends 3 inches so that the length of lamp 1 plus extension base 5 equals the standard length of 48 inches. Extension base 5 is made up of two plastic shells, each comprising half a cylinder, which when mated together, overlap base 3 and form a tube having about the same diameter as envelope 8. The plastic shells are bonded together, and extension base 5 is bonded to base 3. End 6 of extension base 5 is closed off and pins 7 protrude therefrom.

Disposed within extension base 5 is a transformer 9 and a capacitor 10. Capacitor 10 is the impedance which reduces current flow through lamp 1 while consuming very little power and transformer 9 provides the proper heater current through proximate electrode 2. Pins 4, at the right hand end of lamp 1, are connected to the secondary of transformer 9 and pins 7 are connected to the primary. Capacitor 10 is connected across transformer 9, that is to say, one side of capacitor 10 is connected to the primary of transformer 9 and the other side to the secondary; this places capacitor 10 in series with lamp 1.

A comparison test was made in a fixture containing a ballast and two 40 watt rapid start lamps in series. With two standard lamps in the fixture and 120 volts ac applied, the ballast drew 0.781 amperes of current and 87 watts of power. When one of the lamps was replaced by a lamp plus extension base in accordance with this invention, where capacitor 10 had a rating of 4 microfarads, the ballast drew only 0.531 amperes of current and 53 watts of power. The relative light intensity measured about 5 feet below the fixture was about 61% of that with two standard lamps. When a 2 microfarad capacitor was used, the ballast drew 0.456 amperes and 42 watts and said relative light intensity was 42%.

When this invention is used with instant start fluorescent lamps, transformer 9 is omitted from extension base 5, since separate heater current is not provided for the electrodes of instant start lamps.

It may be desirable to place a bleeder resistor across capacitor 10 in order to bleed the charge off the capacitor when the lamp is turned off. It may also be desirable to place a thermal breaker in series with capacitor 10 in order to protect the capacitor at the end of life.

Most of the fluorescent lamps used for general lighting in this country are either 48 inches or 96 inches long. Thus the distance between sockets 11 (shown in dotted lines in the drawing) for most applications of this invention would be 48 or 96 inches.

Extension base 5 need not be rigidly attached to lamp 1 as shown in the preferred embodiment. It can be made so as to plug into the end of lamp 1. Thus if lamp 1 fails, extension base 5 need not be discarded but could be used with a new lamp 1.

We claim:

1. An elongated fluorescent lamp and elongated extension base for use in a pair of sockets spaced a predetermined distance apart, the fluorescent lamp being shorter than said predetermined distance but the length of the lamp and extension base equalling said predetermined distance, the extension base containing an impedance the purpose of which is to reduce current flow in the lamp.

2. The lamp and extension base of claim 1 wherein said impedance consumes little power itself.

3. The lamp and extension base of claim 1 wherein said extension base is fixedly attached to the end of said lamp.

4. The lamp and extension base of claim 1 wherein said impedance is a capacitor.

5. The lamp and extension base of claim 1 wherein both lamp and extension base are tubular and have about the same diameter.

6. The lamp and extension base of claim 4 wherein said extension base also contains a transformer, one side of the capacitor being connected to the primary of the transformer and the other side of the capacitor being connected to the secondary of the transformer.

* * * * *